US006019152A

United States Patent [19]

Haynes et al.

[11] Patent Number: 6,019,152

[45] Date of Patent: Feb. 1, 2000

[54] APPARATUS FOR HEATING NONWOVEN WEBS

[75] Inventors: Bryan David Haynes, Cumming; Jark C. Lau; Lee Cullen Boney, both of Roswell, all of Ga.; Robert James Baldy, Neenah, Wis.

[73] Assignee: Kimberly-Clark Worldwide, Inc., Neenah, Wis.

[21] Appl. No.: 09/124,539

[22] Filed: Jul. 29, 1998

[51] Int. Cl.[7] ..... D06B 19/00

[52] U.S. Cl. ..... 156/433; 156/497; 156/82; 425/83.1; 425/446; 425/472; 264/109

[58] Field of Search ..... 156/62.2, 82, 181, 156/290, 433, 436, 497; 264/109; 425/83.1, 446, 404, 472

[56] References Cited

U.S. PATENT DOCUMENTS

| | | | |
|---|---|---|---|
| 3,338,992 | 8/1967 | Kinney . | |
| 3,341,394 | 9/1967 | Kinney . | |
| 3,502,538 | 3/1970 | Petersen . | |
| 3,502,763 | 3/1970 | Hartmann . | |
| 3,542,615 | 11/1970 | Dobo et al. . | |
| 3,617,417 | 11/1971 | Olson | 156/181 |
| 3,692,618 | 9/1972 | Dorschner et al. . | |
| 3,802,817 | 4/1974 | Matsuki et al. . | |
| 3,849,241 | 11/1974 | Butin et al. . | |
| 4,340,563 | 7/1982 | Appel et al. . | |
| 4,364,156 | 12/1982 | Greenway et al. . | |
| 4,567,796 | 2/1986 | Kloehn et al. . | |
| 5,108,820 | 4/1992 | Kaneko et al. . | |
| 5,108,827 | 4/1992 | Gessner . | |
| 5,167,745 | 12/1992 | Governale | 156/285 |
| 5,336,552 | 8/1994 | Strack et al. . | |
| 5,382,400 | 1/1995 | Pike et al. . | |
| 5,707,468 | 1/1998 | Arnold et al. . | |

OTHER PUBLICATIONS

Manson, John A. and Sperling, Leslie H.: *Polymer Blends and Composites*, Plenum Press, New York, ISBN 0–306–30831–2, pp. 273–277 (1976).

Patent application 08/877,377, Marman et al, filed Jun. 17, 1997.

*Primary Examiner*—Sam Chuan Yao

*Attorney, Agent, or Firm*—Pauley Peterson Kinne & Fejer

[57] ABSTRACT

An apparatus and method for increasing the heating efficiency of a nonwoven web using heated air are provided. A flow modifier including a turbulence inducing bar arrangement is positioned between the heated air supply and the nonwoven web. The flow modifier increases the turbulence of the heated air before it contacts the nonwoven web, resulting in more thorough penetration of the web by the air, and better convective heat transfer between the heated air and the nonwoven web.

19 Claims, 5 Drawing Sheets

APPARATUS FOR HEATING NONWOVEN WEBS

FIELD OF THE INVENTION

This invention relates to an apparatus and method for heating nonwoven webs using air flow having increased turbulence, to yield improved heat transfer efficiency.

BACKGROUND OF THE INVENTION

Nonwoven fabrics or webs constitute all or part of numerous commercial products such as adult incontinence products, sanitary napkins, disposable diapers and hospital gowns. Nonwoven fabrics or webs have a physical structure of individual fibers, strands or threads which are interlaid, but not in a regular, identifiable manner as in a knitted or woven fabric. The fibers may be continuous or discontinuous, and are frequently produced from thermoplastic polymer or copolymer resins from the general classes of polyolefins, polyesters and polyamides, as well as numerous other polymers. Blends of polymers or conjugate multicomponent fibers may also be employed. Methods and apparatus for forming fibers and producing a nonwoven web from synthetic fibers are well known. Common techniques include meltblowing, spunbonding and carding.

Nonwoven fabrics may be used individually or in composite materials as in a spunbond/meltblown (SM) laminate or a three-layered spunbond/meltblown/spunbond (SMS) fabric. They may also be used in conjunction with films and may be bonded, embossed, treated or colored. Colors may be achieved by the addition of an appropriate pigment to the polymeric resin. In addition to pigments, other additives may be utilized to impart specific properties to a fabric, such as in the addition of a fire retardant to impart flame resistance or the use of inorganic particulate matter to improve porosity. Because they are made from polymer resins such as polyolefins, nonwoven fabrics are usually extremely hydrophobic. In order to make these materials wettable, surfactants can be added internally or externally. Furthermore, additives such as wood pulp or fluff can be incorporated into the web to provide increased absorbency and decreased web density. Such additives are well known in the art.

Qualities such as strength, softness, elasticity, absorbency, flexibility and breathability are readily controlled in making nonwoven fabrics. However, certain properties must often be balanced against others. An example would be an attempt to lower costs by decreasing fabric basis weight while maintaining reasonable strength. Nonwoven fabrics can be made to feel cloth-like or plastic-like as desired. The average basis weight of nonwoven fabrics for most applications is generally between 5 grams per square meter and 300 grams per square meter, depending on the desired end use of the material.

Nonwoven fabrics have been used in the manufacture of personal care products such as disposable infant diapers, children's training pants, feminine pads and incontinence garments. Nonwoven fabrics are particularly useful in the realm of such disposable absorbent products because it is possible to produce them with desirable cloth-like aesthetics at a low cost. Nonwoven personal care products have had wide consumer acceptance. The elastic properties of some nonwoven fabrics have allowed them to be used in form-fitting garments, and their flexibility enables the weaver to move in a normal, unrestricted manner. This combination of properties has also been utilized in materials designed for treating injuries. Kimberly-Clark's FLEXUS™ wrap, for example, is effective in providing support for injuries without causing discomfort or complete constriction. The SM and SMS laminate materials combine the qualities of strength, vapor permeability and barrier properties; such fabrics have proven ideal in the area of protective apparel. Sterilization wrap and surgical gowns made from such laminates are widely used because they are medically effective, comfortable and their cloth-like appearance familiarizes patients to a potentially alienating environment.

Various mechanisms have been employed for increasing the integrity of nonwoven webs such as spunbonded filament webs. Bonding of nonwoven webs can be accomplished by a variety of methods typically based on heat and/or pressure, such as through air bonding and thermal point bonding. Ultrasonic bonding, hydroentangling and stitchbonding may also be used. There exist numerous bonding and embossing patterns that can be selected for texture, physical properties and appearance.

One method is compaction, in which the web is passed between heated and/or unheated nip rollers to cause interfilament bonding. Another known mechanism is the hot air knife. A hot air knife is useful in bonding the individual polymer filaments together at various locations, so that the web has increased strength and structural integrity. Hot air knives are also used for aligning meltblown fibers during manufacture of meltblown webs, for cutting nonwoven fabrics, for chopping reclaim, and for a variety of other uses.

One use of the hot air knife is to improve the structural integrity of nonwoven webs before passing them through standard inter-filament bonding processes. Through-air bonding "TAB") is a process of bonding a nonwoven bicomponent fiber web in which air sufficiently hot to melt one of the polymers in the fibers of the web is forced through the web. The air velocity is between 100 and 500 feet per minute and the dwell time may be as long as 6 seconds. The melting and resolidification of the polymer provides the bonding. TAB has relatively restricted variability and since TAB requires the melting of at least one component to accomplish bonding, it is most effective when applied to webs with two components like conjugate fibers or those which include an adhesive. In one method, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component and thereby forms bonds between the filaments to integrate the web.

The TAB process requires the web to have some initial structural integrity, sufficient to hold the web together during TAB. The hot air knife has been used to provide nonwoven webs (e.g., spunbond webs) with initial structural integrity prior to TAB.

A conventional hot air knife includes a manifold with a slot that blows a jet of hot air onto the nonwoven web surface. U.S. Pat. No. 4,567,796, issued to Kloehn et al., discloses a hot air knife which follows a programmed path to cut out shapes needed for particular purposes, such as the leg holes in disposable diapers. U.S. Pat. No. 5,707,468, issued to Arnold et al., discloses using a hot air knife to increase the integrity of a spunbond web. U.S. patent application Ser. No. 08/877,377, to Marmon et al., filed Jun. 17, 1998, discloses a zoned hot air knife assembly used to heat discrete portions of a nonwoven web.

Hot air knives have proven useful in many areas. However, as explained above, they require large quantities of air heated to high temperatures, in order to be effective. There is a need or desire for techniques which improve the heating efficiency of hot air knives used to heat nonwoven webs, thereby lowering the energy requirements and associated costs.

SUMMARY OF THE INVENTION

The invention is directed generally to an apparatus and method for improving the efficiency of the heating and bonding of nonwoven webs using high temperature air. It has been discovered that hot air, which is directed to a nonwoven web at a given flow rate and temperature, can be made to heat the nonwoven web more efficiently by increasing the level of turbulence in the air flow.

In some applications, there is no need to increase the heating effect of the air. Instead, the main objective can be to reduce the energy required to achieve the same heating effect. By increasing the turbulence of the air, the apparatus and method of the invention can achieve the same heating effect using less air, and/or a lower air temperature.

The apparatus of the invention includes a device, which can be a conventional device, for directing heated air to a nonwoven web. The device includes a source of heated air, a flow control mechanism, a plenum, and one or more supply openings associated with the plenum directed at the nonwoven web.

The apparatus of the invention further includes a turbulence inducing flow modifier positioned in the one or more supply openings, or between the one or more supply openings and the nonwoven web. The flow modifier may include a turbulence inducing bar arrangement, and can be a wide-mesh screen or other bar arrangement. As the heated air passes through the turbulence inducing bar arrangement, it is split into a plurality of smaller streams which interfere with each other to cause turbulence.

The heated air having more turbulent flow can more effectively penetrate the narrow openings between the nonwoven web filaments, resulting in exposure of more filament surface area to the heated air. This, in turn, results in faster and more efficient heating of the nonwoven web. In order for turbulence to occur, the heated air need only be supplied at a conventional or lower flow rate and velocity. The bar arrangement causes turbulence without requiring increased flow, and may require less flow due to the improved filament penetration and heating efficiency.

With the foregoing in mind, it is a feature and advantage of the invention to provide an apparatus and method for increasing heat transfer from a hot air stream to a nonwoven web, by increasing the turbulence of the air stream.

It is also a feature and advantage of the invention to provide an apparatus and method for heating a nonwoven web, which reduces the energy requirement by increasing the heating efficiency.

The foregoing and other features and advantages will become further apparent from the following detailed description of the presently preferred embodiments, read in conjunction with the accompanying drawings. The detailed description and drawings are intended to be illustrative rather than limiting, the scope of the invention being defined by the appended claims and equivalents thereof.

DEFINITIONS

Figure 1:
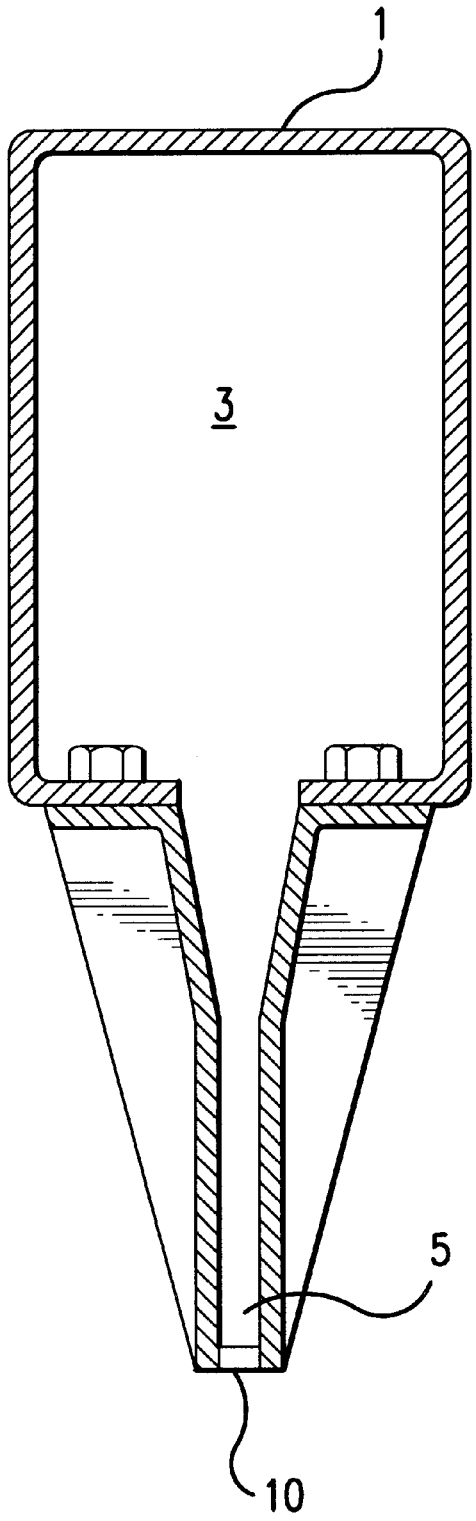
FIG. 1 is a cross-sectional view of a conventional hot air knife, used to supply hot air to a nonwoven web.

As used herein, the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The term also includes films that have been perforated or otherwise treated to allow air to pass through. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91.)

As used herein, the term "microfibers" means small diameter fibers having an average diameter not greater than about 75 microns, for example, having an average diameter of from about 0.5 micron to about 50 microns, or more particularly, microfibers may have an average diameter of from about 2 microns to about 40 microns.

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al. Spunbond fibers are quenched and generally not tacky on the surface when they enter the draw unit, or when they are deposited onto a collecting surface. Spunbond fibers are generally continuous and have average diameters larger than 7 microns, often between about 10 and 20 microns.

As used herein, the term "spunbonded web" refers to a nonwoven mat comprised of spunbonded fibers.

As used herein, the term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface.

As used herein, the term "meltblown fabric" refers to a nonwoven mat being comprised of meltblown fibers.

As used herein, the term "polymer" generally includes but is not limited to, homopolymers, copolymers, such as for example, block, graft, random and alternating copolymers, terpolymers, etc. as well as isotactic, syndiotactic, and atactic steroisomers thereof and blends and modifications thereof. Furthermore, unless otherwise specifically limited, the term "polymer" shall include all possible geometrical configurations of the material. These configurations include, but are not limited to isotactic, syndiotactic and atactic symmetries.

As used here, the term "machine direction" or MD means the length of a fabric in the direction in which it is produced. The term "cross machine direction" or CD means the width of fabric, i.e., a direction generally perpendicular to the MD.

As used herein, the term "bicomponent" refers to fibers which have been formed from at least two polymers extruded from separate extruders but spun together to form one fiber. Bicomponent fibers are also sometimes referred to as multicomponent or conjugate fibers. The polymers are usually different from each other though bicomponent fibers may be made from fibers of the same polymer. The polymers are arranged in substantially constantly positioned distinct zones across the cross-section of the bicomponent fibers and extend continuously along the length of the conjugate fibers. The configuration of such a bicomponent fiber may be, for example, a sheath/core arrangement wherein one polymer is surrounded by another or may be a side by side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein, the term "biconstituent fibers" refers to fibers which have been formed from at least two polymers extruded from the same extruder as a blend. The term "blend" is defined below. Biconstitutent fibers do not have the various polymer components arranged in relatively constantly positioned distinct zones across the cross-sectional area of the fiber and the various polymers are usually not continuous along the entire length of the fiber, instead they usually form fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2 on Pages 273 through 277.

As used herein, the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "turbulence inducing bar arrangement" refers to an arrangement of bars which are large enough, and far enough apart, to cause a wake-induced increase in turbulence of a gas which passes between the bars. A more detailed description is provided below. The bars are larger and further apart than the elements in mesh screens and similar devices which reduce turbulence instead of increasing it.

As used herein, the term "hot air knife" refers to a device through which a stream of heated air under pressure can be emitted and directed. With such a device, it is also possible to control the air flow of the resultant jet of heated air. A conventional hot air knife is described in coassigned U.S. Pat. No. 5,707,468 issued Jan. 13, 1998, and U.S. Pat. No. 4,567,796 issued Feb. 4, 1986; both of which are hereby incorporated by reference in their entireties.

As used herein, the term "composite" or "composite material" refers to a material which is comprised of one or more layers of nonwoven fabric combined with one or more other fabric or film layers. The layers are usually selected for the different properties they will impart to the overall composite. The layers of such composite materials are usually secured together through the use of adhesives, entanglement or bonding with heat and/or pressure.

DETAILED DESCRIPTION OF THE PRESENTLY PREFERRED EMBODIMENTS

A typical hot air knife operates on the exchange of energy from an air jet via convection to the nonwoven web, or impingement heat transfer. The hot air knife is typically positioned very close to the nonwoven web surface, preferably from about 0.75–3.0 inches above the surface. At this distance, the nonwoven web is exposed to the jet potential core, which is the region of maximum temperature and velocity in the air jet which leaves the hot air knife. This is also the region of lowest turbulence intensity. For convective heat transfer to occur at optimum efficiency, the turbulence of the air is more important than its velocity. The present invention provides an apparatus and method for increasing the turbulence intensity.

Referring to FIG. 1, hot air knife 1 includes an elongated plenum 3 which receives air from a source (not shown). The air is heated by a heater (not shown), preferably before it enters the plenum. The hot air, which is under pressure, exits the plenum 3 through an elongated slot 5 at high velocity, so that the air jet has a profile resembling that of a knife.

In accordance with the invention, FIGS. 2–6 illustrate various turbulence inducing bar arrangements 10 which can be used to increase the turbulence of the air jet leaving the hot air knife. The turbulence inducing bar arrangement 10 may be configured to mount just inside the exit of the air knife nozzle 5 as shown in FIG. 1, or may be positioned below the nozzle 5 and above the nonwoven web. Preferably, the turbulence inducing bar arrangement 10 is mounted at the nozzle exit as shown.

Figure 2:
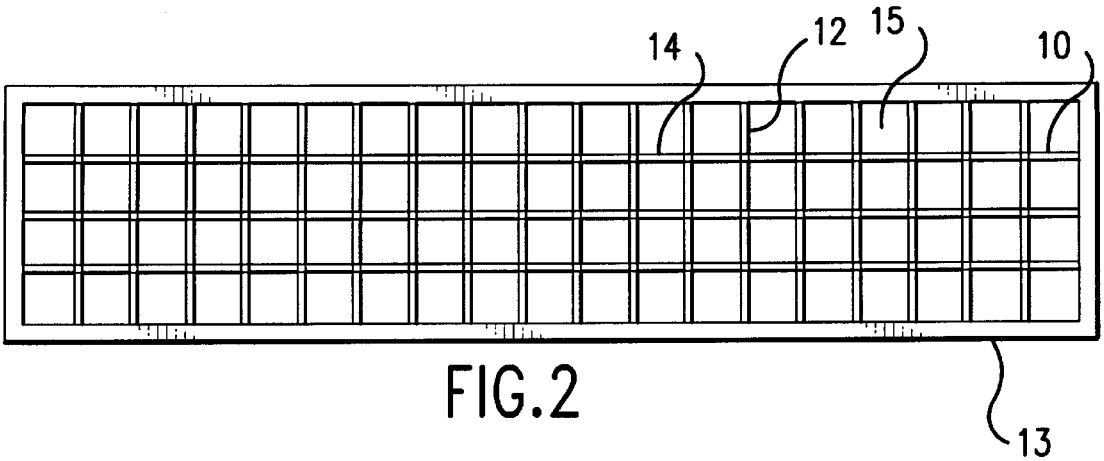
FIGS. 2–6 illustrate different turbulence inducing bar arrangements which can be used at the exit of the supply opening slot of the hot air knife of FIG. 1, to increase the turbulence of hot air flowing through the supply opening.

In the embodiment shown in FIG. 2, the bar arrangement 10 includes a plurality of intersecting horizontal and vertical bars 12 and 14 arranged in a checkerboard fashion, extending the length and width of the hot air knife nozzle 5. The vertical bars 12 extend across the width of the nozzle and are perpendicular to its length. The horizontal bars 14 extend across the length of the nozzle and are perpendicular to its width, and to the intersecting bars 12. The bars shown in FIG. 2 have a uniform size and spacing between them. Openings 15, which may be square-shaped as shown, are defined between the bars. The bars 12 and 14 may be supported by an outer frame 13 extending around the perimeter of the bar arrangement.

Figure 7:
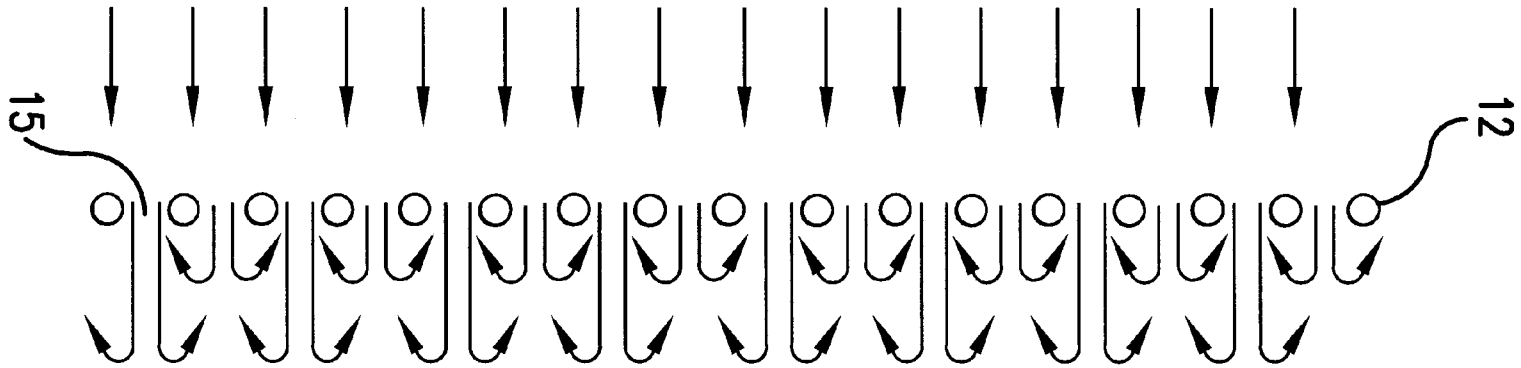
FIG. 7 schematically illustrates how a turbulence inducing bar arrangement converts one or more streams of air flow into streams having greater turbulence, by dividing the initial stream or streams into smaller streams which interfere and collide with each other.

The bars 12 and 14 may have a flat cross-sectional profile, which is rectangular or square. The bars may alternatively have a circular cross-sectional profile, as shown in FIG. 7. The bars may alternatively have a wide variety of other cross-sections defined by triangles, ellipses, clovers, diamonds, trapezoids, parallelpipeds, and other shapes.

Figure 3:
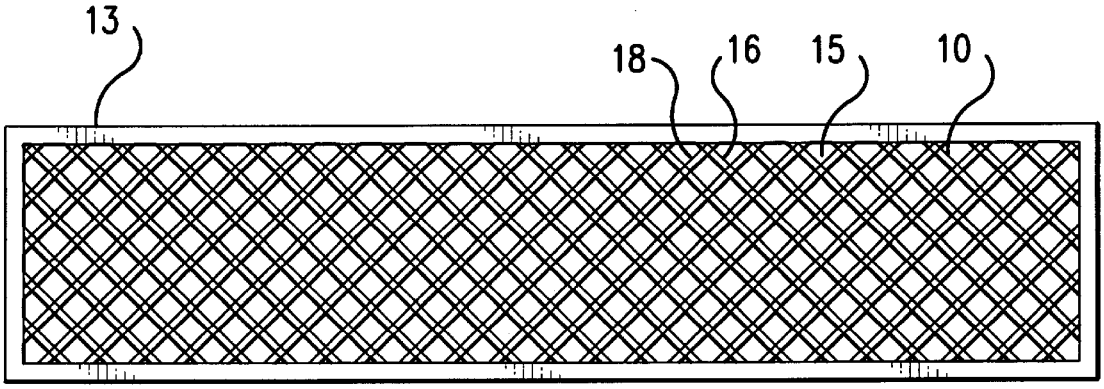

In the embodiment shown in FIG. 3, the bar arrangement 10 includes a first set of parallel bars 16 slanted at 45-degree angles below a longitudinal axis of the hot air knife nozzle 5, and a second set of parallel bars 18 slanted at 45 degrees above a longitudinal axis of the nozzle. The bars 16 and 18 may intersect at right angles as shown. The angle of intersection is not critical so long as the openings 15 defined between the bars are not so narrow as to impede the turbulence enhancement achieved by the bar arrangement. Again, the bars 16 and 18 may have a wide variety of cross-sectional shapes.

Figure 4:
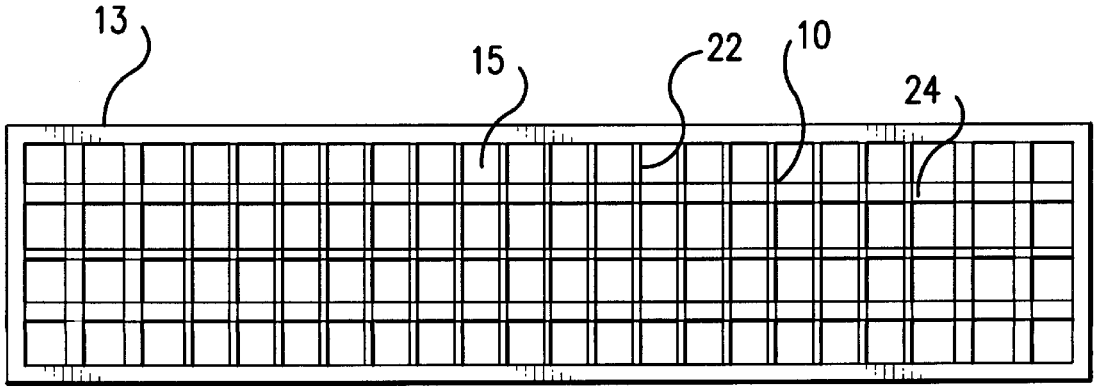

In the embodiment shown in FIG. 4, the width-extending bars 22 and length-extending bars 24 are larger near the edges of the slot-shaped nozzle opening 5 than in the center. One effect of this is that the openings 15 are larger at the center of the slot 5 than near the edges or comers. As a result, more air flows through the openings 15 near the center, and at higher velocities, than near the edges and comers.

Figure 5:
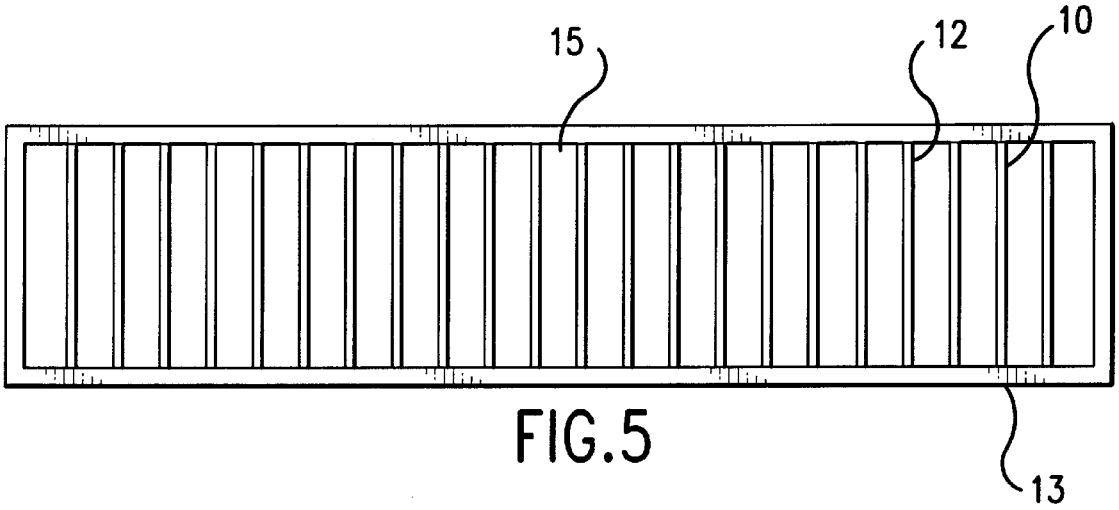

In the embodiment shown in FIG. 5, the bar arrangement 10 includes only one set of substantially parallel nonintersecting bars 12 extending the width of the hot air knife slot opening, and substantially perpendicular to the profile of the air jet leaving the hot air knife. The bars 12 are substantially identical and evenly spaced from each other. Open spaces 15 of substantially uniform size are present between the bars.

Figure 6:
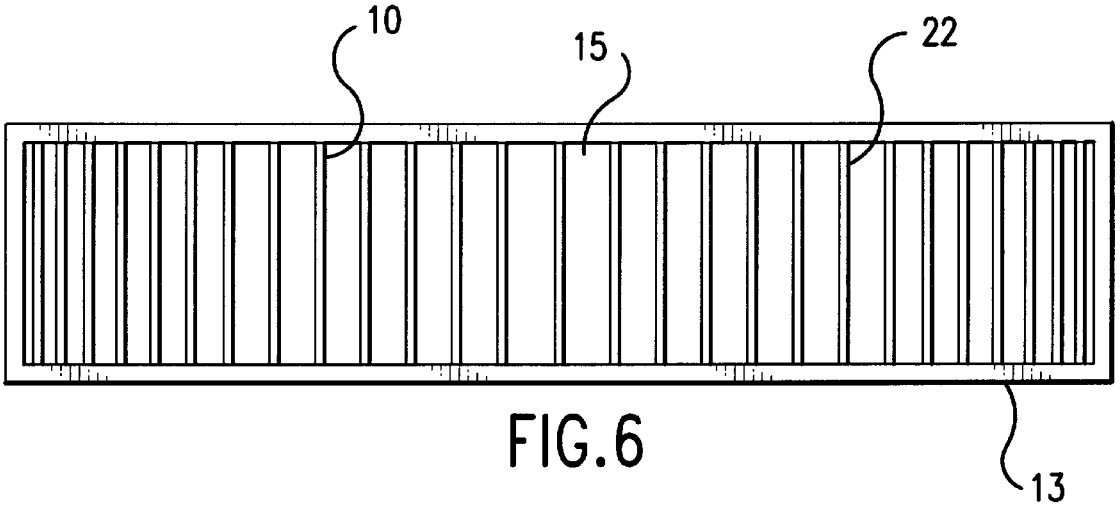

In the embodiment shown in FIG. 6, the bar arrangement 10 includes only one set of substantially parallel bars 22 extending the width of the hot air knife slot opening. In the embodiment, the spacing between the bars varies according to a gradient, such that the bars 22 nearest to both ends of the hot air knife slot are closer together than the bars 22 nearest to the center of the hot air knife slot. The open spaces 15 have different sizes and are smaller near the ends of the slot opening than near the center.

Other configurations of the bar arrangement 10 are also possible, and are deemed to be within the scope of the invention.

Referring to FIG. 1, the planar area occupied by the bar arrangement 10 can be defined as the planar area occupied by bars 12 and 14 plus the planar area occupied by open spaces 15 between the bars, and not including the area occupied by outer frame 13. The bars 12 and 14 should occupy about 20–80% of the planar area occupied by the bar arrangement 10, preferably about 30–70% of the planar area occupied by bar arrangement 10, more preferably about 40–60% of the planar area occupied by bar arrangement 10. Similarly, the open spaces 15 should occupy about 20–80% of the planar area occupied by bar arrangement 10, preferably about 30–70%, most preferably about 40–60%. If the percentage area occupied by the bars 12 and 14 is too low, the bar arrangement 10 will have little or no effect on converting the flow of supply gas (e.g., air) to turbulent from laminar. If the percentage area occupied by the bars 12 is too large, leaving the open spaces 16 too small, the bar arrangement 10 may behave like a diffusing screen which reduces turbulence instead of increasing it.

The sizing and spacing of bars in the bar arrangement 10 should be such that the hot air jet is converted to turbulent flow having a turbulence intensity greater than about 5%, preferably greater than about 10%, more preferably greater than about 20%, as measured by the test procedure described below. The general operation of the bars is shown schematically in FIG. 7. The parallel arrows illustrate the flow of hot air in the nozzle 5 of hot air knife 1. The semi-circular, vortex-shaped arrows represent wakes illustrative of a more turbulent flow of hot air after the flow has passed through the bar arrangement 10. The interference of the bars in the flow path causes the hot air jet to pass through the openings 15, and splits the flow into a plurality of smaller streams. The smaller streams are directed at higher average velocity downstream from the bars than the main air jet approaching the bars. The smaller streams are also directed at different angles, resulting in multiple wake formation downstream from the bars. This multiple wake formation causes the overall flow to become much more turbulent.

The size of the bars in the bar arrangement 10 should be large enough to split and redirect the flow of quench gas in the manner shown in FIG. 7, so as to cause increased turbulence. If the bars are too small, they will either reduce or fail to significantly increase the turbulence. The bars may have an average diameter of about 0.01–0.50 inch, preferably about 0.05–0.25 inch, more preferably about 0.10–0.15 inch. Similarly, the openings 15 between the bars may have an average width of about 0.01–0.50 inch, preferably about 0.05–0.25 inch, more preferably about 0.10–0.15 inch. The bars (and the overall bar arrangement 10) may be constructed of metal, temperature-resistant plastic, or other materials having suitable structural integrity and heat resistance.

One limiting factor affecting the size of the bars is that the hot air knife slot nozzle 5 is not very wide, and bars which are too large may cause excessive blocking. Generally, the width of the hot air knife slot 5 will be about 0.5 inches or less. The length of the hot air knife slot will vary depending on the width of the nonwoven web, or portion thereof, being treated. As explained above, the dimensions of bars in the bar arrangement 10, and of spaces 15, may be varied within a single bar assembly 10 to create a flow gradient in the hot air being supplied from the hot air knife.

The hot air knife 1 is generally placed above the nonwoven web with the length of the nozzle 5 substantially perpendicular to the machine direction (direction of travel) of the nonwoven web, and substantially extending across the width of the nonwoven web. In an alternative embodiment (described below), the hot air knife may be provided in distinct, separate zones so that only select portions of the nonwoven web are heated. While the description below is for a zoned hot air knife assembly, the operating conditions such as hot air temperature, head pressure and flow velocity, and nonwoven web line speed, are also applicable to the use of a single hot air knife.

Figure 8:
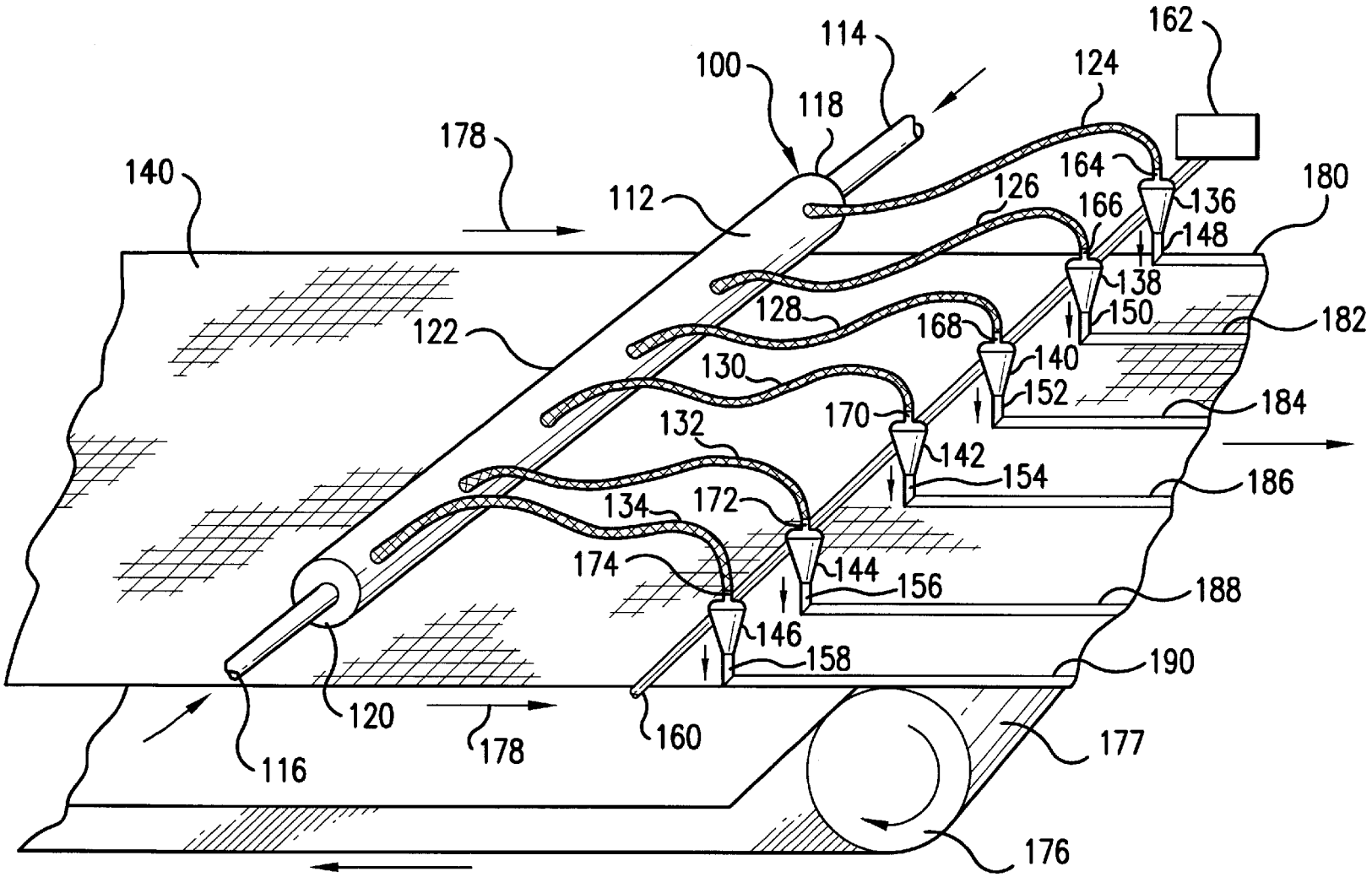
FIG. 8 is a perspective view of a process of bonding a spunbonded filament web, using a hot air knife assembly which supplies hot air in spaced apart zones.

Referring to FIG. 8, a hot air knife assembly 100 includes a header 112 which is supplied with hot air through the inlet channels 114 and 116. The header 112 is shaped like an elongated hollow cylinder having ends 118 and 120 and a main body 122. The hot air supply lines 114 and 116 feed air into the ends 118 and 120 of the header 112, as shown by the arrows.

The hot air supplied to the header 112 may have a temperature of about 200–500° F., more generally about 250–450° F., most commonly about 300–350° F. The optimum temperature will vary according to the polymer type, basis weight and line speed of the nonwoven web 140 traveling beneath the hot air knife assembly 100. For a polypropylene spunbond web having a basis weight of about 0.5–1.5 osy, and traveling at a line speed of about 1000–1500 feet per minute, a hot air temperature of about 300–350° F. is desirable. Generally, the hot air temperature should be at or near (e.g., slightly above) the melting temperature of the resin being bonded.

The header 112 feeds hot air to six hot air knife plenums 136, 138, 140, 142, 144 and 146. The preferred volumetric flow of hot air being fed to each hot air knife from the header 112 is generally dependent on the composition and weight of the web, the line speed, and the degree of bonding required. The air flow rate may be controlled by controlling the pressure inside the header 112. The air pressure inside the header 112 is preferably between about 1–12 inches of water (2–22 mm Hg), more preferably between about 4–10 inches of water (8–18 mm Hg). Of course, the volume of hot air required to effect the desired level of inter-fiber bonding may be reduced by increasing the temperature of the hot air. Operating parameters such as line speed, hot air volume, and hot air temperature can be determined and adjusted using techniques known and/or available to persons of ordinary skill in the art.

In the embodiment shown in FIG. 8, the header 112 is cylindrical, but it can be rectangular or of another shape. Numerous sizes and shapes can be employed for the header 112, with the preferred size depending largely on the width of the nonwoven web and the degree of bonding required. The header 112 can be constructed from aluminum, stainless steel, or another suitable material.

Extending from the header 112 are six spaced apart hot air conduits 124, 126, 128, 130, 132 and 134. The conduits may be rigid or flexible, but are preferably made of a flexible material in order to permit adjustment and/or movement. The conduits are each connected at one end to the header 112, and at the other end to one of six plenums 136, 138, 140, 142, 144 and 146. Each plenum engages a hot air knife slot, with the slots being labeled 148, 150, 152, 154, 156 and 158. The plenums and slots shown in FIG. 8 may each have a cross-section similar to that shown in FIG. 1, and described above. The difference is that the hot air knife of FIG. 1 comprised a single elongated plenum and slot extending across the web, whereas the hot air knife assembly 100 of FIG. 8 is divided into a plurality of spaced apart plenums and knife slots.

Hot air from the header 112 is preferably supplied at roughly equal volume and velocity to each of the conduits 124, 126, 128, 130, 132 and 134. This equal division of flow can be accomplished in simple fashion, by ensuring that the conduits are of equal dimensions and size and that the air pressure is uniform at the entrances to the conduits. On the other hand, if a particular application warrants feeding more or less air into some of the conduits than the others, different flow rates can be accomplished by individually valving the conduits, by designing them with different sizes, or by valving the plenums.

The plenums 136, 138, 140, 142, 144 and 146 are mounted to a slidable support bar 160. The plenums are mounted so that the lower tips of the air knife slots 148, 150, 152, 154, 156 and 158 are at a predetermined distance above the nonwoven web 140. The distance between the air knife slots and the nonwoven web should be about 0.25 to about 10 inches, preferably about 0.75 to about 3.0 inches, most preferably about 1.0 to about 2.0 inches. Preferably, the plenums are adjustably mounted to the support bar 160 so that the distance between the knife slots and the web can be varied according to the needs of the application.

A control panel 162 is provided on one side of the hot air knife assembly 100, incorporating individual flow controls for hot air entering the plenums. As shown, the plenums are provided with individual flow control valves 164, 166, 168, 170, 172 and 174 which can be used to individually adjust the air flow to each plenum. The flow control valves may be electronically linked to individual controls at the control panel 162 using conventional techniques available to persons skilled in the art. As explained above, it is often desirable to have roughly equal air flow to each of the plenums. The valves can be used for fine tuning and equalizing the air flows to the plenums, or for differentiating between them if different flows are desired.

In the embodiment of FIG. 8, turbulence inducing bar arrangements as described previously (having the same or different configurations) can be installed in each of the individual hot air knives. Alternatively, a single elongated turbulence inducing bar arrangement can be mounted just below all of the hot air knives, and above the nonwoven web. Alternatively, turbulence inducing bar arrangements having the same or different configurations can be selectively installed to influence flow from some, but not all, of the hot air knives, to provide zones of varying turbulence. It is also possible to install two or more turbulence inducing bar arrangements superimposed on each other, to increase the turbulence of air flowing from one or more of the hot air knives. Other variations of the invention are also possible.

The initially unbonded nonwoven web 140 is carried on an endless belt conveyor including a carrying screen 177 driven by rollers (one of them at 176) at a predetermined line speed. The nonwoven web 140 travels in the machine direction (indicated by arrow 178) underneath the hot air knife assembly 100, at a speed of generally about 100–3000 feet per minute, more commonly about 500–2500 feet per minute, desirably about 1000–2000 feet per minute. The hot air knife slots 148, 150, 152, 154, 156 and 158 apply jets of hot air through the one or more turbulence inducing bar arrangements and into the nonwoven web, causing localized bonding between the nonwoven web filaments to occur, at spaced apart locations. The spaced apart bonding causes formation of "tread lines" representing the bonded areas 180, 182, 184, 186, 188 and 190. In the embodiment shown, the tread lines are linear. In another embodiment, the support bar 160 is in communication with an oscillator (not shown) which causes the support bar 160 to move back and forth in the transverse direction (i.e., perpendicular to the machine direction) as the nonwoven web 140 is carried forward in the machine direction. By using an oscillator, the tread lines 180, 182, 184, 186, 188 and 190 can be formed in a wavelike pattern including without limitation sine waves, triangular waves, square waves, trapezoidal waves, or irregular waves.

The thicknesses of the tread lines 180, 182, 184, 186, 188 and 190 correspond to the lengths of the air knife slots 148, 150, 152, 154, 156 and 158. Generally, the tread lines are as narrow as possible, to minimize the compaction and densification of the nonwoven web. The air knife slots may each have a length less than about 1.0 inch, preferably less than about 0.5 inch, more preferably about 0.10–0.25 inch. The length of the air knife slots will correspond substantially to the width of the bonded regions in the web 140. The lengths of the air knife slots (i.e., perpendicular to the movement of the web) may be determined based on the overall percentage of bond area desired. When the hot air knife assembly is used for pre bonding a nonwoven web, the area of the web covered by the pre-bonding should be less than about 10% of the nonwoven web area, preferably about 1–5% of the nonwoven web area, more preferably about 2–3% of the nonwoven web area.

The width of the openings in the hot air knife slots 148, 150, 152, 154, 156 and 158 (i.e., the width of the opening as shown in FIG. 1) should be configured to give the desired velocity of air jets hitting the surface of the web 140. The actual velocity of the air jets is determined by the air pressure inside the header 112, the total number of air knife slots, the lengths of the air knife slots, and the widths of the hot air knife slots. The desired air jet velocity from the air knife slots is whatever velocity is required to cause adequate bonding between the nonwoven web filaments. Generally, the width of each air knife slot opening (i.e., parallel to the direction of movement of the web) should be about 0.5 inch or less. Generally, the air velocity is about 1,000–25,000 feet per minute, preferably about 5,000–20,000 feet per minute, more preferably about 8,000–15,000 feet per minute.

The number of spaced apart air knife plenums and slots may vary according to the width of the nonwoven web being treated, the lengths of the individual air knife slots, and the dimensions of the zones being treated. Nonwoven webs may have widths of about 12 inches to 140 inches or higher, and the number of zones requiring treatment may increase with the width. The same "zoned" hot air knife effect may be created by providing a single hot air knife extending the width of the nonwoven web, and by blocking off selected portions of the hot air knife slot to create zones.

The controlled turbulence hot air knife assembly of the invention may be used to efficiently increase the integrity of a wide variety of spunbond nonwoven webs. The webs may, for instance, be constructed of a wide variety of polymers including without limitation polyamides, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A–B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, polybutadiene, isobutylene-isoprene copolymers, and combinations of any of the foregoing. The webs may also be constructed of bicomponent or biconstituent filaments or fibers, as defined above. The inter-filament bonding is effected as the nonwoven web 140 (FIG. 8) moves underneath the hot air knife and is contacted with one or more jets of hot air, preferably within about 15 degrees of perpendicular to the web. As a consequence of the thermal energy imparted by the combination of temperature, pressure, and turbulent flow rates of the one or more air jets, the nonwoven web filaments are melted and bonded together at points of contact below the hot air knife or knives, for example, the bonding or "tread" lines 80, 82, 84, 86, 88 and 90 shown in FIG. 8.

The controlled turbulence hot air knife assembly and process of the invention are also useful for other purposes. Other uses include, without limitation, the bonding together of layers in spunbond/meltblown web laminates or spunbond/meltblown/spunbond web laminates, and the production of bonded carded webs.

Conventional hot air knives dispense air flow which typically has a low turbulence intensity. As explained above, the turbulence inducing bar arrangements of the invention increase the turbulence intensity. To measure turbulence intensity, a hot wire anemometer can be used. The instrument includes a probe, a major signal processing unit that produces a mean voltage, and a volt meter used to supply an RMS (root mean square) voltage. The probe is positioned at the location of interest in the flow of air, and a mean voltage is measured. The RMS voltage is divided by the mean voltage, and the result is multiplied by 100% to obtain the percent turbulence intensity.

While the embodiments of the invention described herein are presently considered preferred, various modifications and improvements can be made without departing from the spirit and scope of the invention. The scope of the invention is indicated by the appended claims, and all changes that fall within the meaning and range of equivalency are intended to be embraced therein.

We claim:

1. An apparatus for heating and bonding a nonwoven web, comprising:

a hot air knife assembly for directing heated air to a nonwoven web, the hot air knife assembly including a source of heated air, a flow control mechanism, a plenum, and one or more hot air knife slots associated with the plenum and directed at a nonwoven web; and at least one turbulence inducing bar arrangement positioned in the one or more hot air knife slots;

wherein the bar arrangement includes a plurality of spaced apart bars, and open spaces between the bars.

2. The apparatus of claim 1, wherein the bar arrangement comprises a plurality of intersecting bars and open spaces between the bars.

3. The apparatus of claim 1, wherein the bar arrangement comprises a plurality of substantially parallel nonintersecting bars.

4. The apparatus of claim 1, wherein the bars are substantially evenly spaced from each other.

5. The apparatus of claim 1, wherein the open spaces between the bars vary in size.

6. The apparatus of claim 1, wherein the bar arrangement has a planar area, the intersecting bars occupy about 20–80% of the planar area, and the open spaces constitute about 20–80% of the planar area.

7. The apparatus of claim 1, wherein the intersecting bars occupy about 30–70% of the planar area, and the open spaces constitute about 30–70% of the planar area.

8. The apparatus of claim 1, wherein the intersecting bars occupy about 40–60% of the planar area, and the open spaces constitute about 40–60% of the planar area.

9. The apparatus of claim 1, wherein the hot air knife slot has a length and a width, and the turbulence inducing bar arrangement comprises a plurality of bars extending the width of the slot.

10. The apparatus of claim 9, wherein the bar arrangement further comprises one or more bars extending the length of the slot.

11. The apparatus of claim 1, wherein the hot air knife slot has a length and a width, and the turbulence inducing bar arrangement comprises a plurality of bars at an angle relative to the length of the slot.

12. The apparatus of claim 1, wherein the turbulence inducing bar arrangement comprises bars having the same diameter.

13. The apparatus of claim 1, wherein the turbulence inducing bar arrangement comprises bars having two or more different diameters.

14. The apparatus of claim 1, wherein the turbulence inducing bar arrangement comprises bars having diameters between about 0.01–0.50 inch.

15. The apparatus of claim 14, wherein the bars have diameters between about 0.05–0.25 inch.

16. The apparatus of claim 14, wherein the bars have diameters between about 0.10–0.15 inch.

17. The apparatus of claim 1, wherein the turbulence inducing bar arrangement comprises bars having cross-sectional shapes selected from the group consisting of rectangles, circles, triangles, ellipses, clovers, diamonds, trapezoids and parallelpipeds.

18. The apparatus of claim 1, wherein the heated air is directed at a velocity of about 1,000–25,000 feet per minute.

19. The apparatus of claim 1, wherein the heated air is directed at a temperature of about 200–550° F.

* * * * *

UNITED STATES PATENT AND TRADEMARK OFFICE

CERTIFICATE OF CORRECTION

PATENT NO : 6,019,152

DATED : 01 February 2000

INVENTOR(S) : Bryan David HAYNES, et al.

It is certified that error appears in the above-identified patent and that said Letters Patent are hereby corrected as shown below:

In column 3, line 1, delete "1998" and insert --1997-- in its place.

In column 5, line 52, delete "IBSN" and insert --ISBN-- in its place.

Signed and Sealed this

Third Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,019,152
APPLICATION NO. : 09/124539
DATED : February 1, 2000
INVENTOR(S) : Bryan David Haynes et al.

It is certified that error appears in the above-identified patent and that said Letters Patent is hereby corrected as shown below:

In column 3, line 1, delete “1998” and insert --1997-- in its place.

In column 5, line 52, delete “IBSN” and insert --ISBN-- in its place.

Signed and Sealed this

Sixth Day of November, 2007

JON W. DUDAS
*Director of the United States Patent and Trademark Office*